United States Patent [19]

Onoda

[11] Patent Number: 4,462,677

[45] Date of Patent: Jul. 31, 1984

[54] IMAGE FORMATION APPARATUS USING A PROCESS UNIT WITH A PROTECTIVE COVER

[75] Inventor: Shigeyoshi Onoda, Kawasaki, Japan

[73] Assignee: Canon Kabushiki Kaisha, Tokyo, Japan

[21] Appl. No.: 381,684

[22] Filed: May 25, 1982

[30] Foreign Application Priority Data

Jun. 22, 1981 [JP] Japan ..... 56-96407
Apr. 16, 1982 [JP] Japan ..... 57-64152

[51] Int. Cl.[3] ..... G03G 15/00

[52] U.S. Cl. ..... 355/3 R; 355/3 DR; 355/14 R; 355/71

[58] Field of Search ..... 355/3 R, 14 R, 71, 67, 355/3 DD, 3 DR, 3 SH; 430/120; 118/620

[56] References Cited

U.S. PATENT DOCUMENTS 3,883,242 5/1975 Takahashi et al. ..... 355/3 R
3,966,316 6/1976 Pfeifer et al. ..... 355/3 DR
3,985,436 10/1976 Tanaka et al. ..... 355/3 DD X
4,114,998 9/1978 Shimizu et al. ..... 355/3 DR
4,166,692 9/1979 Okada et al. ..... 355/3 R X
4,254,202 3/1981 Matsumoto et al. ..... 430/120
4,335,950 6/1982 Gunzelmann et al. ..... 355/3 SH X
4,357,095 11/1982 Sugawa et al. ..... 355/3 R
4,376,577 3/1983 Okamoto ..... 355/3 R X
4,376,579 3/1983 Wakao ..... 355/3 DR

*Primary Examiner*—A. C. Prescott
*Attorney, Agent, or Firm*—Fitzpatrick, Cella, Harper & Scinto

[57] ABSTRACT

This specification discloses an image formation apparatus having an image bearing member and process device acting on the image bearing member. The image formation apparatus having an image bearing member, process device acting on the image bearing member, a cover movable to a first position for covering the surface of the image bearing member and a second position retracted away from the first position, and a device for moving the cover in response to other operation of the main body of the apparatus.

20 Claims, 18 Drawing Figures

IMAGE FORMATION APPARATUS USING A PROCESS UNIT WITH A PROTECTIVE COVER

BACKGROUND OF THE INVENTION

1. Field of the Invention

This invention relates to an image formation apparatus having an image bearing member and process means acting on the image bearing member.

2. Description of the Prior Art

Description will hereinafter be made with an electrophotographic copying apparatus taken as an example of the image formation apparatus.

An electrophotographic copying apparatus requires the interchange of various expendables such as supply of developer, discard of waste toner, cleaning of corona wire, etc. or disposal during unsatisfactory feeding of transfer medium and maintenance and check-up of the apparatus. Also, when the jam of a transfer medium occurs, it is necessary to deal with the jammed transfer medium. In the past, when the maintenance of the copying apparatus has been effected, there has been an undesirable possibility that a hand or a tool may touch the surface of the image bearing member and injure that surfaces.

Usually, when maintenance is effected, that front door or the like of the apparatus is opened or the apparatus body is divisionally opened in the vertical direction, but this has led to the undesirable possibility that extraneous light enters into the copying apparatus body so that the surface of the image bearing member, particularly the surface of the image bearing member in the image transfer area is exposed to light which deteriorates the photosensitive layer of the image bearing member where the image bearing member has such photosensitive layer.

Further, recently, as shown in U.S. Pat. No. 3,985,436, it has been considered to construct a kit in which the image formation means such as a photosensitive drum, a developing device, a cleaner, a charger, etc. are made into a unitary structure and to interchange the various units at a time during interchange of the photosensitive drum, thereby reducing the maintenance work. By adopting the above-described construction, the user can simply interchange each process unit which particularly requires periodical maintenance, thus reducing the maintenance work to be done by the service man. Further, by interchanging the kit with a process kit which contains toner of another color, formation of colored images becomes possible. Alternatively, by interchanging the kit with a process kit which incorporates other developing means, the user can use developing means corresponding to the original image to be copied.

However, when the kit is interchanged or when the kit is removed from the apparatus body, the hand may touch the photosensitive drum held by the kit to stain or injure the drum. Possibly, the photosensitive drum having, for example, a zinc oxide photosensitive layer or an organic semiconductor photosensitive layer as the image bearing member held by the kit may be exposed to light with a result that the photosensitive layer is deteriorated. The injury or stain on the photosensitive drum or the deterioration of the photosensitive layer may adversely affect the formed images.

Particularly, where a process kit is used, the kit is often interchanged for the purpose of preservation or for the purpose of interchange with a process kit containing therein toner of another color as previously described, even during a period in which the kit is usable, and therefore it is necessary to positively protect the photosensitive drum.

SUMMARY OF THE INVENTION

It is an object of the present invention to provide an image formation apparatus in which, when maintenance of the apparatus such as jam treatment is effected, the surface of the image bearing member can be prevented from being injured or stained.

It is another object of the present invention to provide an image formation apparatus in which, when maintenance of the apparatus such as jam treatment is effected, the surface of the image bearing member is prevented from being exposed to light and thereby deteriorated.

It is still another object of the present invention to provide an image formation apparatus in which the image bearing member is protected to thereby enable clear images to be obtained.

That is, in its one aspect, the present invention is characterized by an image bearing member, process means acting on the image bearing member, a cover movable to a first position for covering the surface of the image bearing member and a second position retracted away from the first position, and means for moving the cover in response to another operation of the main body of the apparatus.

In its other aspect, the present invention is characterized by an image bearing member, process means acting on the image bearing member, a cover movable to a first position for covering the surface of the image bearing member and a second position retracted away from the first position, and means for biasing the cover to the first position for covering the surface of the image bearing member.

Thus, in the process kit or the image formation apparatus of the present invention, the image bearing member can be reliably protected to thereby enable clear images to be obtained.

The invention will become more fully apparent from the following detailed description thereof taken in conjunction with the accompanying drawings.

DESCRIPTION OF THE PREFERRED EMBODIMENTS

The present invention will hereinafter be described in greater detail with respect to some embodiments thereof.

Description will first be made of an embodiment of a copying apparatus to which the present invention is applicable.

Figure 1:
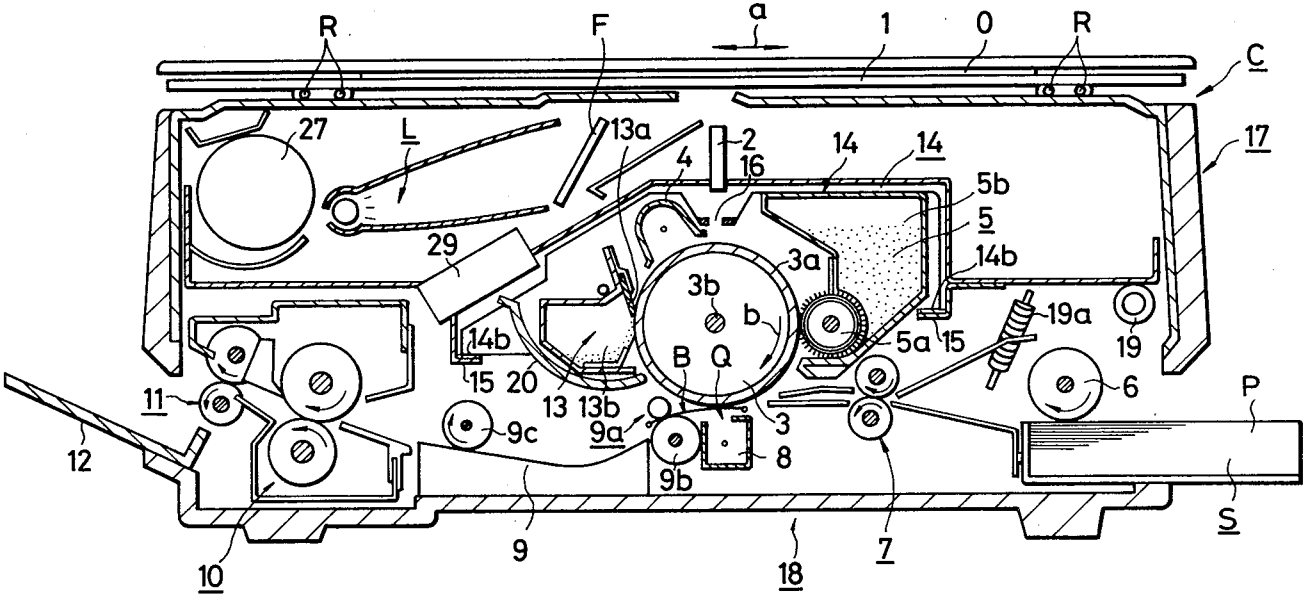
FIG. 1 is a cross-sectional view of a copying apparatus to which an embodiment of the present invention is applied.
Figure 2:
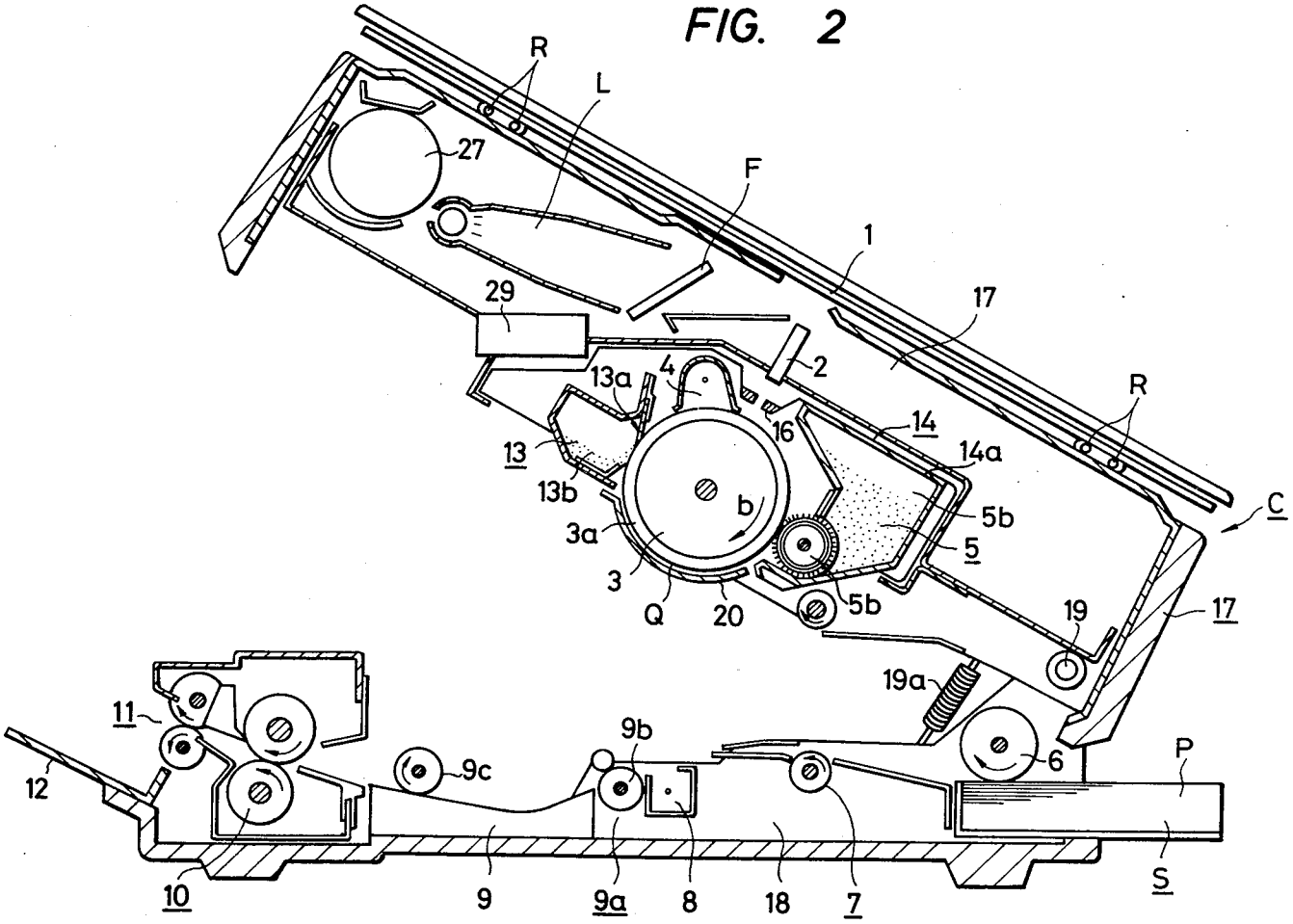
FIG. 2 is a cross-sectional view showing the main body of the copying apparatus as it is opened.

FIG. 1 is a cross-sectional view of a copying apparatus body C. FIG. 2 is a cross-sectional view of the FIG. 1 copying apparatus body as it is opened. In these Figures, reference numeral 1 designates an original carriage formed of a transparent material such as glass and reciprocable on rails R in the direction of arrow a. Reference numeral 2 denotes a short-focus small-diameter imaging element array. An original 0 placed on the original carriage 1 is illuminated by an illuminating lamp L and the reflected optical image thereof is slit-exposed onto a photosensitive drum 3 by the array 2. The photosensitive drum 3 is rotatable about its axis 3*b* in the direction of arrow b. Designated by 4 is a charger for uniformly charging the photosensitive drum 3 covered with a zinc oxide photosensitive layer or an organic semiconductor photosensitive layer 3*a*. The drum 3 uniformly charged by the charger 4 is subjected to image exposure by the element array 2, whereby an electrostatic latent image is formed on the drum. This electrostatic latent image is developed into a visible image by a developing device 5 comprising a magnetic roller 5*a* and a toner reservoir 5*b*. On the other hand, a sheet P contained in a cassette S is fed onto the drum 3 by a feed roller 6 and register rollers 7 rotated in synchronism with the image on the photosensitive drum 3. By a transfer discharger 8, the toner image on the photosensitive drum 3 is transferred onto the sheet P. Thereafter, the sheet P is separated from the drum 3 by separator means 9*a* (for example, a separating belt B shown or a separating corona discharger or the like) and directed to a fixing device 10 by a guide 9 and a pinch roller 9*c* for fixation of the toner image on the sheet P, whereafter the sheet P is discharged onto a tray 12 by discharge rollers 11. After the transfer of the toner image, any toner remaining on the drum 3 is removed therefrom by a cleaner 13. This cleaner 13 comprises a blade 13*a* and a toner reservoir 13*b*. Reference numeral 9*b* designates a separating roller, F denotes a heat absorbing filter, and reference numeral 16 designates a slit opening for directing the original image to the surface of the drum 3.

In the present embodiment, the photosensitive drum 3, and the charger 4, the developing device 5, the cleaner 13 and the filter F disposed around the photosensitive drum 3 are surrounded by a frame member 14*a* as a light-intercepting wall, and together constitute a process kit 14. As will hereinafter be described, this process kit 14 is provided with respect to the main body C so that it is withdrawable or dismountable in the direction of the rotational axis of the drum 3 when the main body is opened, and when the process kit is mounted or dismounted with respect to the main body, the sliding portion 14*b* of the frame member 14*a* of the process kit 14 is engaged with the main body side guide 15 and guided thereby. The frame member 14*a* is formed of black rigid plastic or alternatively of metal or wood.

Now, as shown in FIG. 2, the copying apparatus C is coupled by a support shaft 19 so that is can be divided into an upper housing 17 and a lower housing 18, and the upper housing 17 is upwardly pivotable about the support shaft 19 by a spring 19*a*. The process means such as the illuminating optical system 2, L, the photosensitive drum 3, the developing device 5 and the cleaner 13 are disposed within the upper housing 17. The feed roller 6, the transfer discharger 8, the separator means 9*a*, the guide 9 and the fixing device 10 are disposed in the sheet transportation path within the lower housing 18. Thus, by the upper housing 17 being upwardly pivoted, the sheet transportation path becomes open.

Description will now be made of a case where the upper housing 17 is upwardly pivoted in order to enable maintenance of the copying apparatus such as jam treatment to be effected.

In the figure, reference numeral 20 designats a cover for shielding and protecting the exposed surface of the drum 3. The cover 20 is provided below the process kit 14 integrally therewith. This cover 20 is formed of black rigid plastic of the same quality as the frame member 14*a*, for example, ABS resin, or a metal plate such as an iron plate, and is of a curved shape so as to intercept light so that light does not impinge on the surface of the photosensitive drum 3 and also to prevent the drum surface from being damaged. The zinc oxide photosensitive layer or the organic semiconductor photosensitive layer 3*a* used in the present embodiment is liable to be deteriorated particularly for the wavelength of 300–400 nm or 400 nm or less, but the black plastic plate or the iron plate can reliably intercept the light of such wavelength range.

Figure 3:
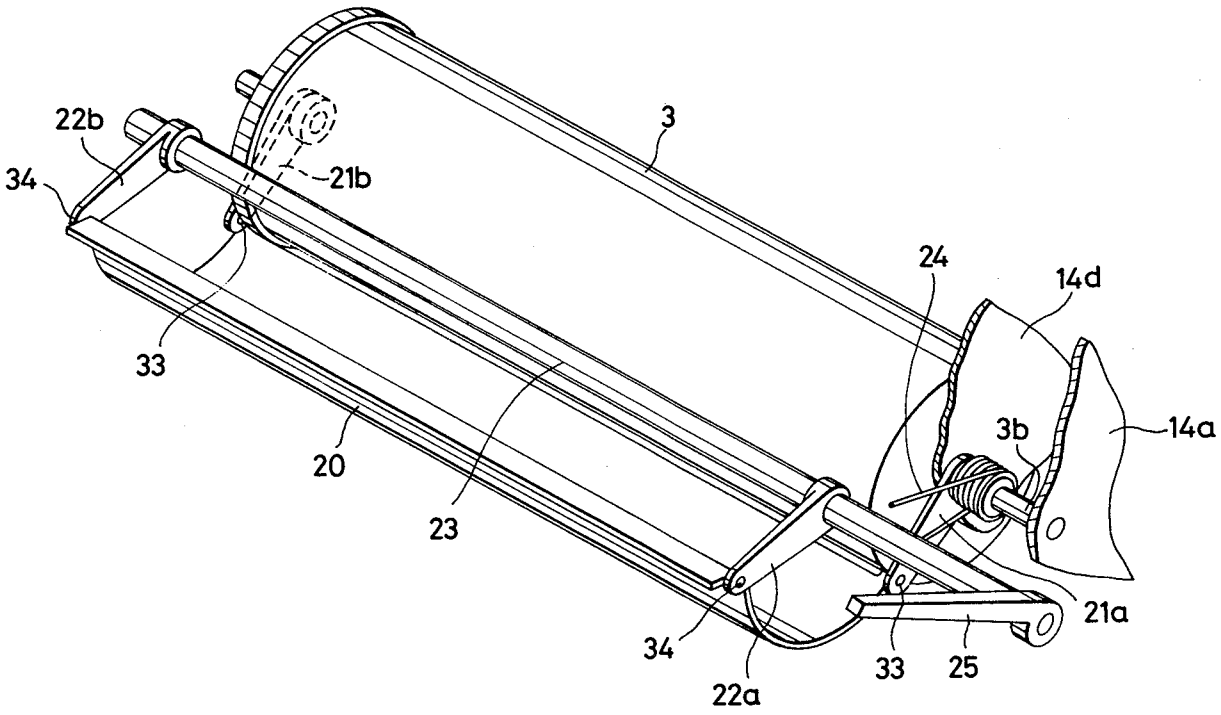
FIG. 3 is a perspective view of a cover.
Figure 4:
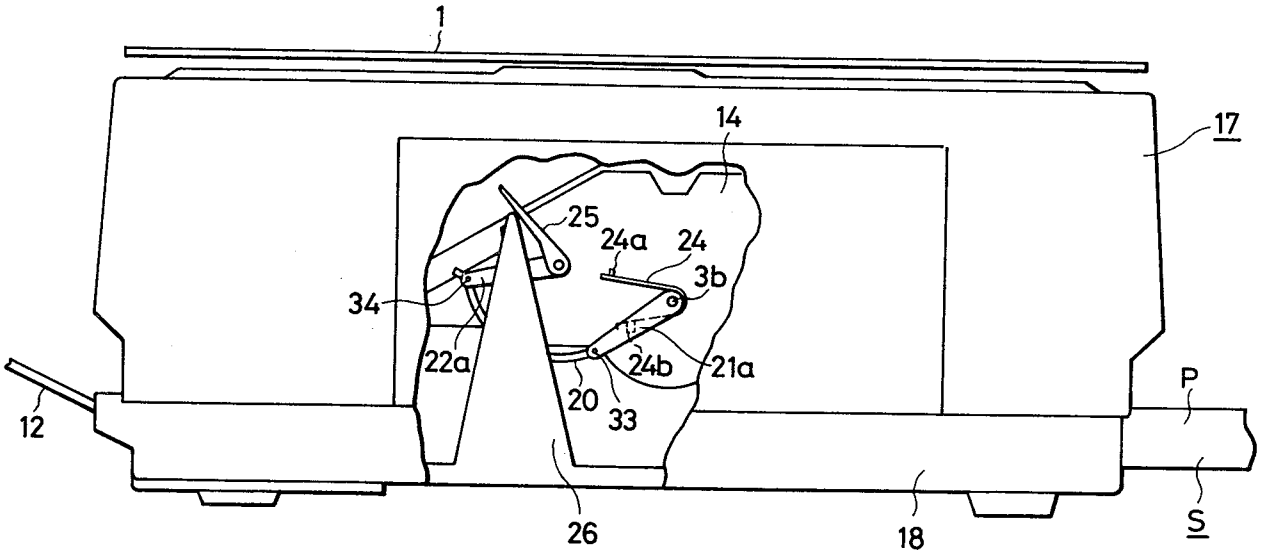
FIGS. 4 and 5 are side views showing a mechanism for moving the cover.

FIG. 3 shows an example of the construction thereof. In FIG. 3, there are pivotable arms 21*a* and 21*b* on the shaft 3*b* of the photosensitive drum 3 at the lengthwise opposite ends thereof, and the ends of these arms are rotatably fitted on the lengthwise opposite ends of the drum cover 20 by means of a shaft 33. Further, the lengthwise opposite ends of the other end portion of the drum cover 20 are rotatably engaged with pivotable arms 22*a* and 22*b* by means of a shaft 34. The pivotable arms 22*a* and 22*b* are fixed to a shaft 23. An operating lever 25 is fixed to the end of the shaft 23. The pivotable arms 21*a* and 21*b*, as shown, are biased for counterclockwise rotation by a spring 24 (if required, a similar spring may be provided also for the arm 21*b*). That is, the cover 20 is always biased to a position for covering the surface of the drum 3. The spring 24 has the opposite ends thereof restrained by a projection 24*a* on the inner cover 14*d* of the kit 14 and a projection 24*b* on the arm 21*a* (FIGS. 4 and 5).

In the above-described construction, when the operating lever 25 is moved clockwisely by a mechanism to be described, the shaft 23 is also rotated clockwisely and the cover 20 can be rotated clockwisely by the pivotable arms 22*a* and 22*b* each having one end thereof fixed to this shaft. Accordingly, this cover 20 can be retracted from the position for covering the surface of the photosensitive drum 3 (this condition is shown in FIG. 3). Further, in the present embodiment, as shown in FIG. 4, a projection 26 is integrally secured to the lower housing 18 and in a condition in which the kit 14, i.e., the photosensitive drum 3, has been inserted into a predetermined position, this projection 26 bears against the operating lever 25 when the upper housing 17 is closed, thereby pushing this lever 25 upwardly and moving it clockwisely. Thus, by the upper housing 17 being closed, the cover 20 automatically retracts from the surface of the drum 3, so that the transfer area is opened to thereby enable image formation to be effected.

Figure 5:
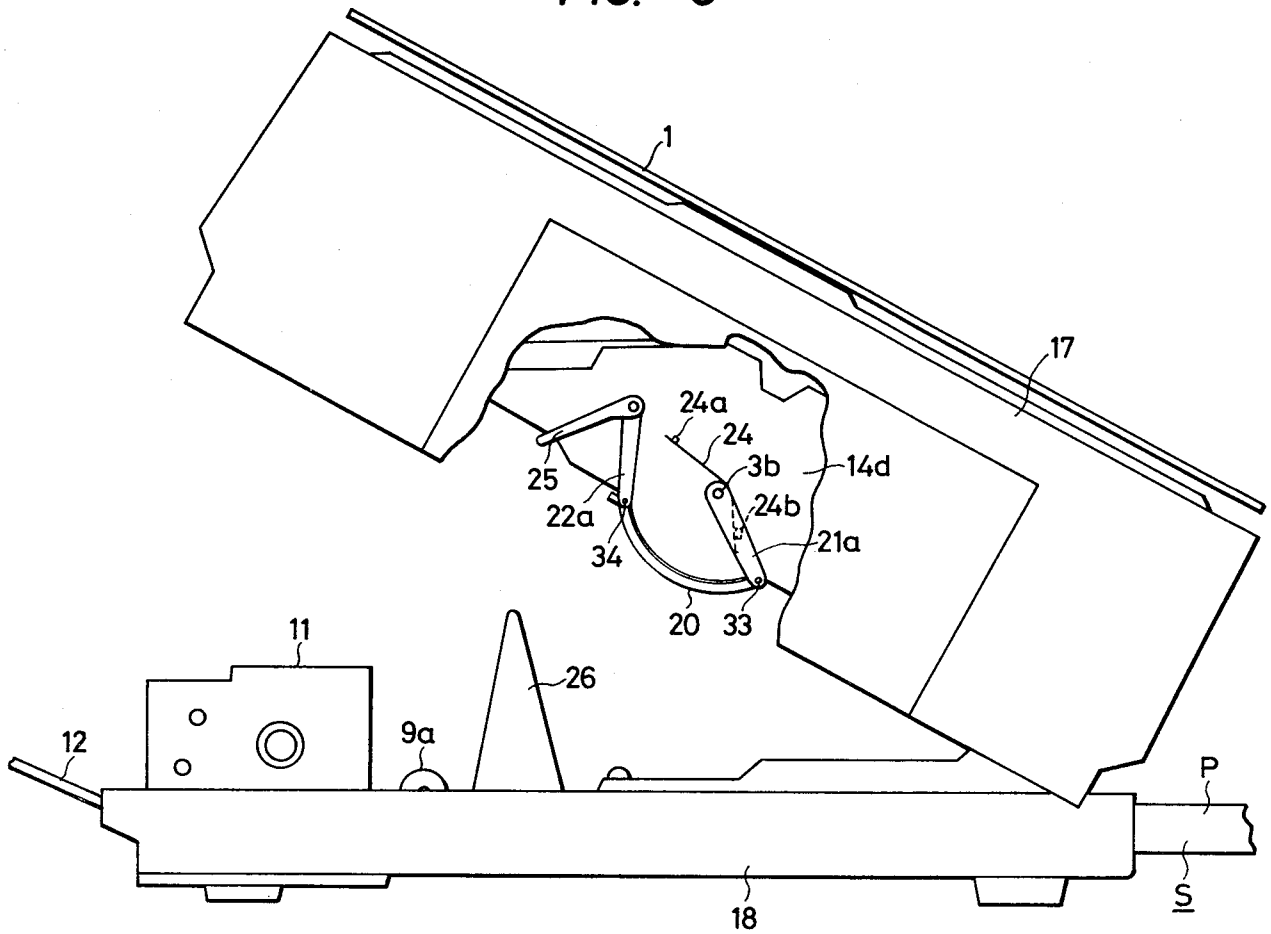

Conversely, when the upper housing 17 is opened upwardly, the operating lever 25 becomes disengaged from the projection 26 as shown in FIG. 5, so that the pivotable arms 21*a* and 21*b* are rotated counter-clockwisely by the resilient force of the spring 24 and in response thereto, the cover 20 is rotated counter-clockwisely to assume a position opposed to the surface of the drum 3, thus covering the exposed portion (transfer portion) of the photosensitive drum 3 from the transfer opening of the frame member 14*a*. That is, when the upper housing 17 is open, the cover 20 automatically covers the exposed portion of the surface of the drum 3 and intercepts light and therefore can prevent the influence of light upon the surface of the drum 3 and also prevent said surface from being damaged.

Further, in the present embodiment, the process kit 14 is constituted by making integral the various process means such as the photosensitive drum 3, the developing device 5, the cleaner 13, the charger 4, etc., and during interchange of the photosensitive drum, the respective units may be interchanged at a time to thereby reduce the maintenance work. That is, when the main body C has been divided and opened, the kit 14 becomes removably mountable along the rails 15, 15 on the copying apparatus body side by a stopper (not shown) being released. In the present embodiment, when the kit 14 is to be taken out of the main body C, it can be drawn out with the exposed portion Q of the photosensitive drum 3 being covered by the cover 20. Thus, light can be prevented from impinging on the surface of the drum 3 and therefore, deterioration or damage of the photosensitive layer can be prevented and the operability can be improved very greatly.

Particularly, where the kit construction is adopted, the surroundings of the kit 14 except for the transfer opening Q are covered by a frame member 30*a* as a light-intercepting wall. Thus, in the present embodiment, when the kit 14 is drawn out from within the copying apparatus body into the light environment, this transfer opening Q is covered by the cover 20 and therefore, the protection effect for the surface of the photosensitive drum is more improved.

Also, in the present embodiment, the spring 24 is provided and by the resilient force of this spring 24, the cover 20 is always biased to a position for covering the surface of the photosensitive drum 3 and therefore, the cover becomes stable at a position for closing the opening Q.

Figure 6:
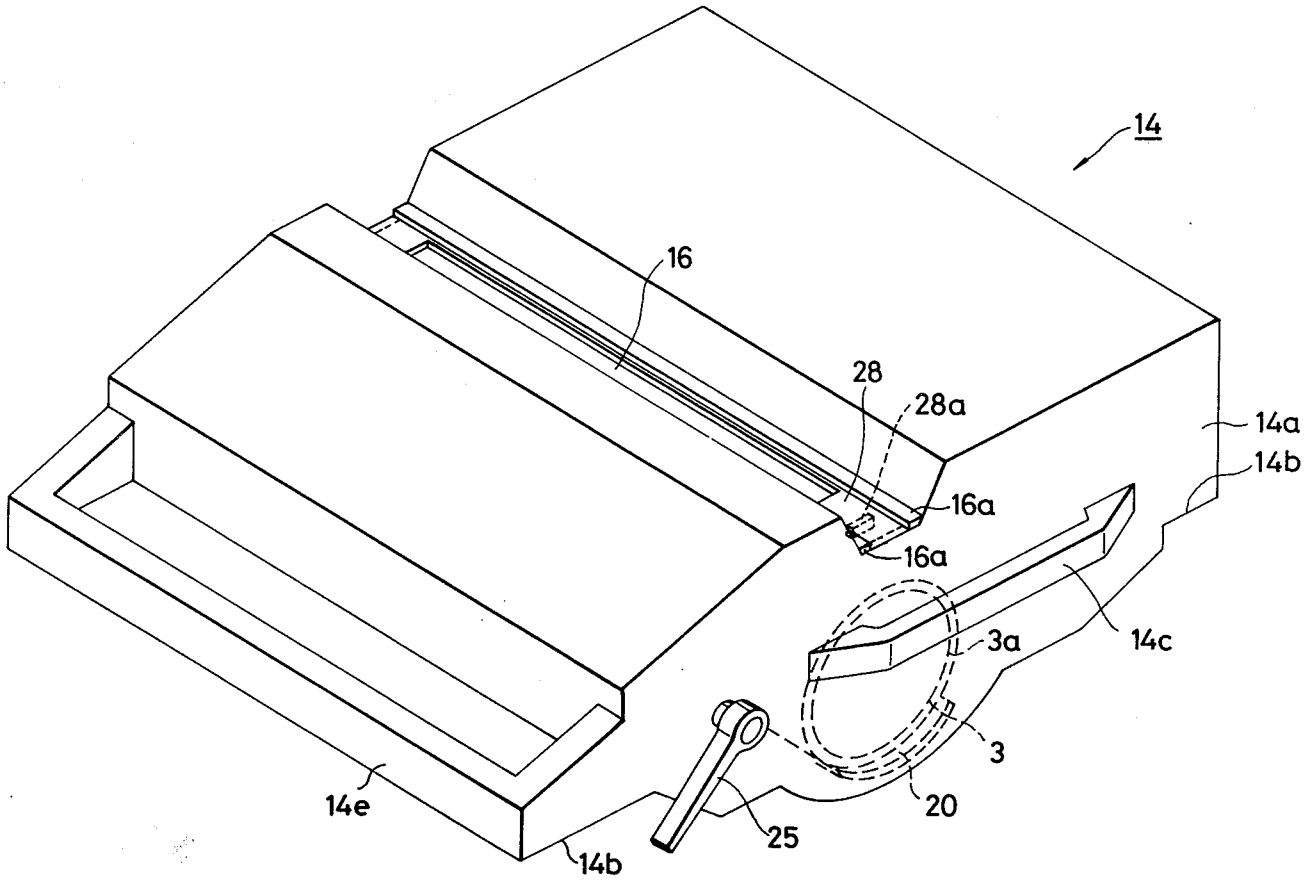
FIG. 6 is a perspective view of a process kit.

Now, FIG. 6 shows a perspective view of the process kit 14 as it has been taken out of the main body C. In FIG. 6, reference numeral 14*c* designates a grip portion for drawing out the kit body along the rails 15, 15 and reference numeral 14*e* denotes a handle portion for holding down the kit taken out. A slit opening 16 for exposure is formed in the upper portion of the kit 14. In the present embodiment, a rail 16*a* is provided along the opening 16 and a light-intercepting plate 28 (indicated by dotted line) can be fitted along this rail 16*a*. This light-intercepting plate 28 is formed of ABS resin or the like having the same light-intercepting function as the wall portion 14*a*, and is slideable in the direction of arrow a by means of a knob 28*a* (indicated by the dotted line) so as to cover the opening 16, whereby the photosensitive drum 3 can be completely shielded from the ambient light and thus, deterioration of the photosensitive layer can be prevented.

However, this opening 16 need not always be shielded from light but, for example, where the width of the slit is small, the light-intercepting plate is not necessary.

As has hitherto been described, according to the present embodiement, even if the apparatus body is divided in two during maintenance of the main body C such as jam treatment, the surface of the photosensitive drum is automatically covered by the cover and therefore, there is no possibility of the drum surface being damaged or deteriorated.

Figure 7:
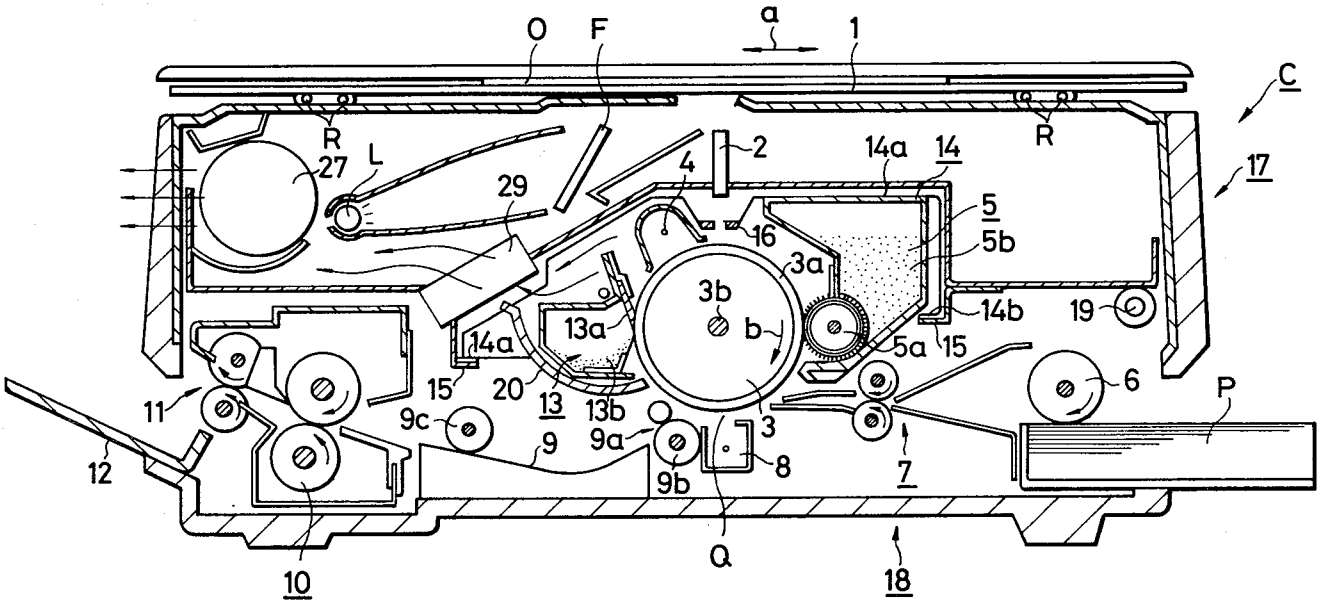
FIG. 7 is a side view for illustrating the air guide of the cover.

Also, in the present embodiment, when the upper housing 17 is in its closed position, if the cover 20 retracts and comes to assume a position near the cleaner 13 shown in FIG. 7, the flow path of the wind created by a fan 27 can be guided by this cover 20. Thus, for example, when the air flows to prevent the ozone around the charger 4 or the temperature rise at the cleaner 13, suitable means are provided. The flow path of the wind is indicated by arrows in FIG. 7. Reference numeral 27 designates a cross flow fan, and reference numeral 29 denotes an ozone filter.

The present embodiment has been described with respect to a case where the upper housing is opened for jam treatment or the like, but even where the housing is not divided into two upper and lower portions, a similar drum light-intercepting member can of course be constructed. For example, with the cover 20 moved to its retracted position by the operating lever 25 being manually moved clockwisely, this lever 25 may be locked by lock means (not shown).

As has been described above, if the present embodiment is used, there can be provided an image formation apparatus in which the image bearing member cannot be deteriorated or damaged even in the case of jam treatment or the like.

Reference is now had to FIGS. 8, 9, 10 and 11 to describe another embodiment.

In this embodiment, the main body is not divided in two and opened, but the conveyor portion is spaced apart from the photosensitive drum 3 to thereby facilitate jam treatment.

Figure 9:
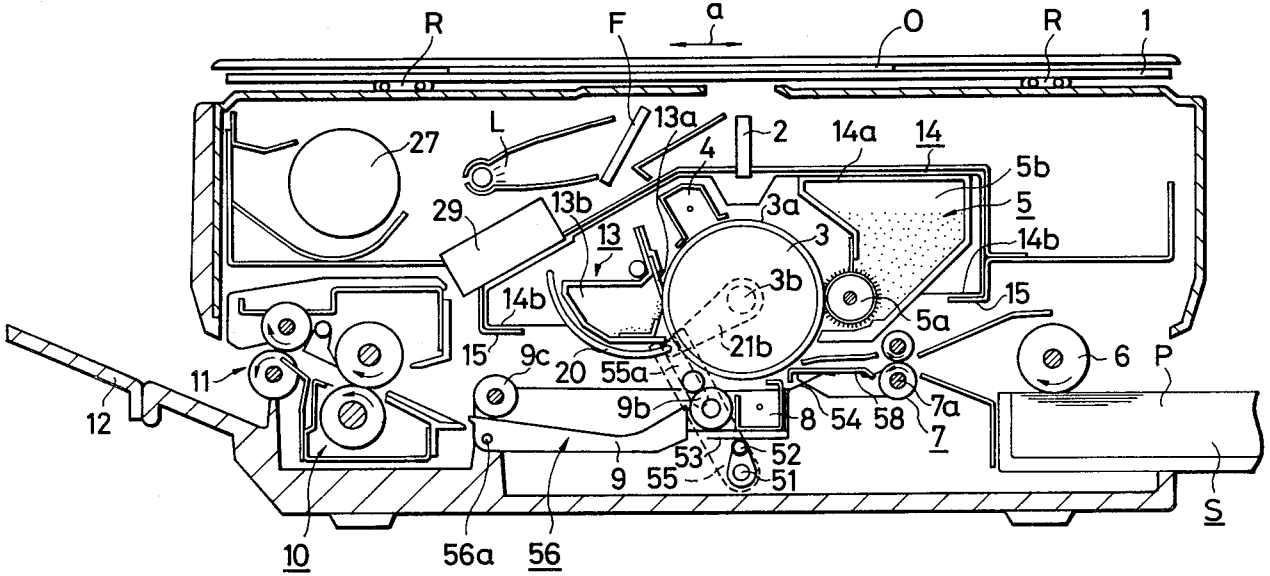
FIGS. 9 and 10 are cross-sectional views of the FIG. 8 copying apparatus.

In FIG. 9, the conveyor portion 56 has a separating roller 9*b* as separator means, a transfer discharger 8, a guide 9 and a conveyance pinch roller 9*c*, and is pivotable about a support shaft 56*a*. By a plate spring 53 provided at one end of the conveyor portion 56 being forced up by a release lever 52, the positional relation between the conveyor portion 56 and the drum 3 is determined by a stopper (not shown). Another plate spring 54 provided in the conveyor portion 56 pushes up a transfer guide 58, and the transfer guide 58 pivotable about the lower roller shaft 7*a* of a register roller 7 bears against a stopper (not shown), whereby the positional relation between the transfer guide 58 and the drum 3 is determined. This condition is the copying capable condition.

Description will now be made of a case where jam is treated.

Figure 8:
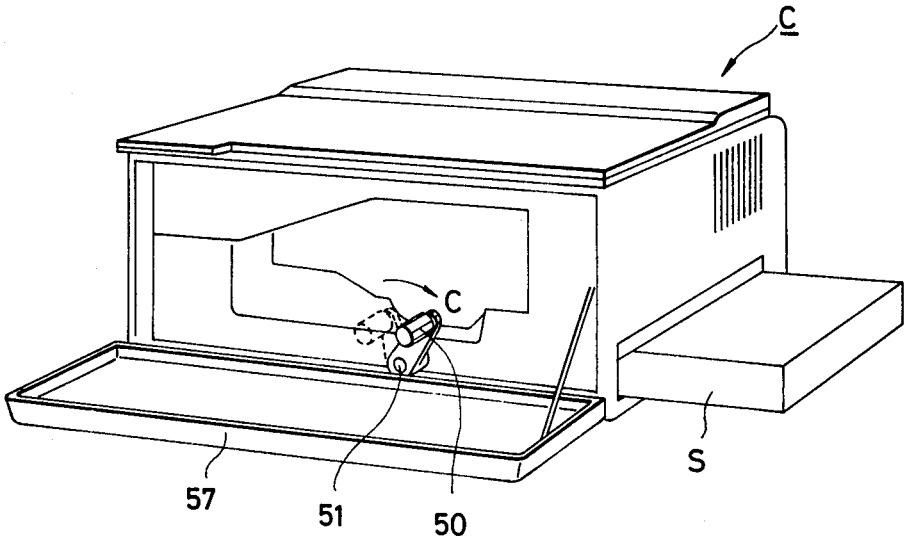
FIG. 8 is a perspective view of a copying apparatus to which another embodiment of the present invention is applied.
Figure 10:
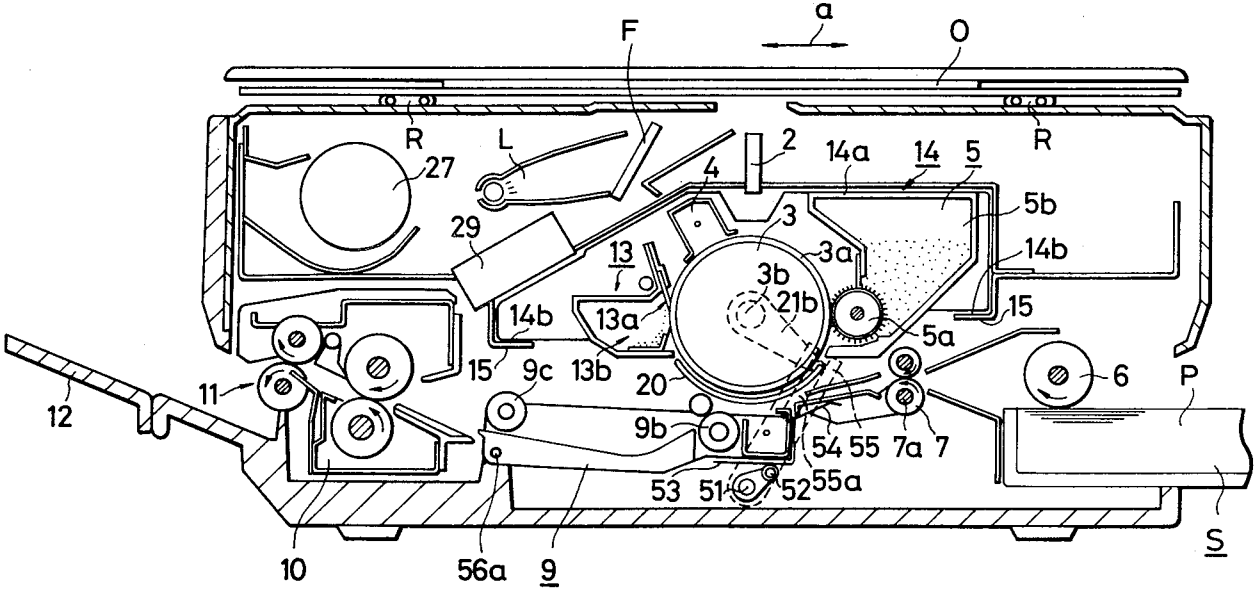

First, the operator opens the front door 57 of the main body C (FIG. 8). Then, the operator brings down a handle 50 clockwisely (in the direction of arrow c) (FIG. 10). The handle 50 is secured to a shaft 51, and by pivotally moving the handle 50, the release lever 52 secured to the shaft 51 is rotated. When the release lever 52 is rotated to the position of FIG. 9, the conveyor portion 56 is moved about a support shaft 56*a* and away from the drum 3. That is, the transfer discharger 8, the guide 9, etc. become spaced apart from the surface of the drum 3. Since the plate spring 54 pivotally moves, the transfer guide 58 is also rotated about the lower roller shaft 7*a* of the register roller 7 and away from the drum 3.

Now, in the present embodiment, when the release lever 52 for jam treatment is operated, the cover 20 is also moved in response to this operation. The mechanism therefor will hereinafter be described.

Figure 11:
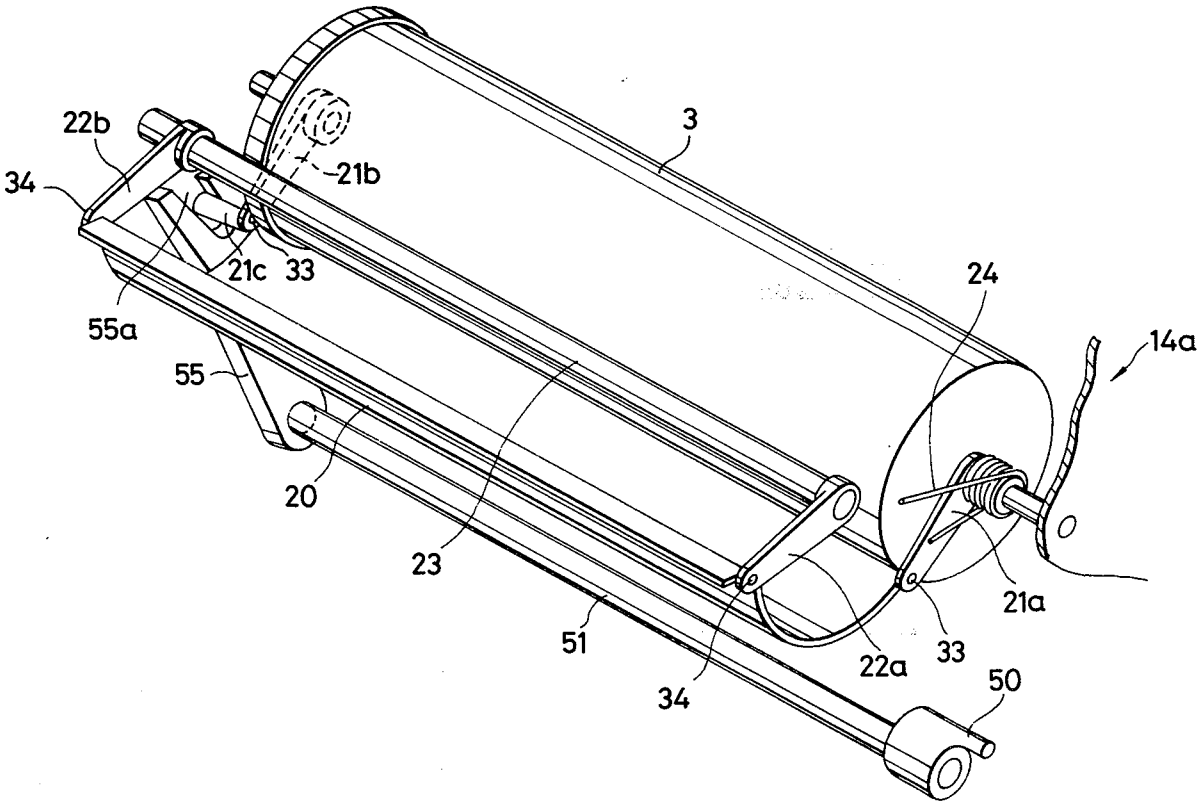
FIG. 11 is a perspective view showing a mechanism for moving the cover.

An arm 55 is secured to one end portion of the shaft 51, and the end of the arm is bifurcated. The pin 21*c* of the pivotable arm 21*b* is engaged with the bifurcated portion 55*a* of the arm 55 (FIG. 11). Thus, the arm 55 also rotates clockwisely in response to the clockwise rotation of the release lever 52. The pivotable arm 21*b* rotates counterclockwisely in response to the movement of the pin 21*c*, and moves, against the resilient force of the spring 24, the cover 20 into the space from which the conveyor portion 56 has been lowered and to a position for covering the surface of the drum 3 (FIG. 10).

Thus, during jam treatment, the drum 3 is protected by the cover. When the lever 52 arrives at the release position of FIG. 9, it is held at that position by the gravity of the conveyor portion 56.

If, after jam treatment, the operator turns the handle 50 counter-clockwisely and returns it to its operative position shown in FIG. 8, the cover 20 will retract from the surface of the drum 3 and the conveyor portion 56 and the transfer guide 58 will return to their operative positions. Again in the present embodiment, the kit 14 is removably mountable with respect to the main body C.

According to the above-described present embodiment, the cover can be moved in response to another operation such as jam treatment, whereby deterioration or damage of the drum 3 can be reliably prevented.

Figure 12:
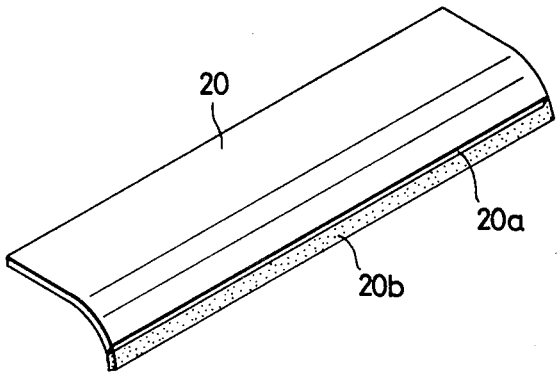
FIG. 12 is a perspective view showing another embodiment of the cover.

FIG. 12 shows still another embodiment.

In this embodiment, sponge-like moltplene 20*b* is attached to the end 20*a* of the cover 20. Thus, the gap between the end 20*a* of the cover 20 and the bottom of the frame member 14*a* is completely closed to thereby enhance the light-intercepting effect.

Each of the above-described embodiments has been shown with respect to a case where the cover is formed of a black non-transparent rigid material so that light may not impinge on the surface of the photosensitive drum 3 and the surface of the drum 3 may not be injured. However, the present invention is not restricted thereto, but the cover may be formed, for example, of a non-transparent soft material (black-polyester film, moltplene or the like) primarily for the purpose of light-interception (including reflection and absorption of light) or formed of a transparent rigid material (transparent plastic or the like) primarily for that purpose. Further, the cover need not always be formed of a non-transparent material, but may be formed of a light-transmitting material if it can intercept light rays of a wavelength range which will deteriorate the photosensitive layer. Also, for example, in the case of an image formation method wherein a magnetic latent image is formed on an insulating layer, preventing the insulating layer from being injured will become a primary purpose of the cover.

The material of the cover may be a metal such as iron, aluminum or the like, or another known material such as resin, wood or the like. If, of these materials, a material having elasticity is employed, the opening-closing operation of the cover can be accomplished more smoothly. Further, if, of these materials, a shock-resisting material is selected, the kit can be mounted or dismounted with the photosensitive drum 3 being covered by the cover.

In the present embodiment, an image bearing member provided with an organic semiconductor photosensitive layer or a zinc oxide photosensitive layer has been known as an example, whereas it will be apparent that the present invention is not restricted thereto but some other photosensitive layer is also usable. In the present invention, the image bearing member is not restricted to one using a photosensitive layer but it will be apparent that the invention is also applicable, for example, to an image bearing member using an insulating layer or the like. The shape of the image bearing member is not restricted to the drum shape, but may be, for example, an endless belt passed over pulleys.

The present invention is not restricted to the magnetic brush development, but other developing systems such as, for example, the cascade development, the fur brush development or the powder cloud development are also applicable.

The cleaning system is not restricted to the blade cleaning, but the fur brush cleaning, the roller cleaning, the web cleaning or the like is applicable.

Further, the imaging element is not restricted to the short-focus small-diameter imaging element array, but may also be an ordinary lens or a bar lens or the like.

The process for image formation is restricted in no way, but for example, the Carlson system, the NP system (U.S. Pat. No. 3,666,363) or the PIP system is also applicable.

Figure 13A:
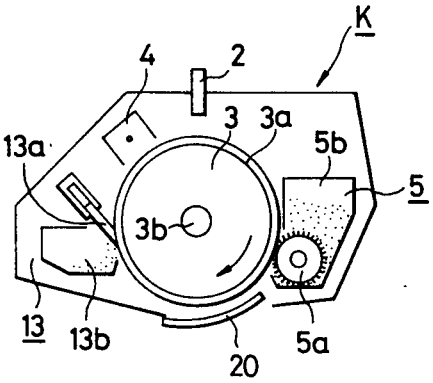
FIGS. 13A–13F are side views of further embodiments of the kit.
Figure 13B:
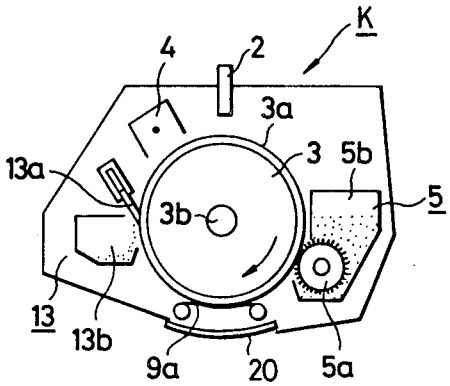
Figure 13C:
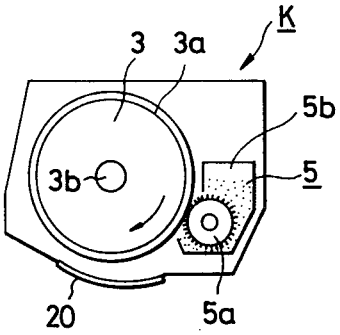
Figure 13D:
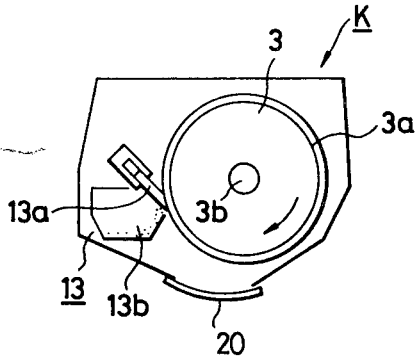
Figure 13E:
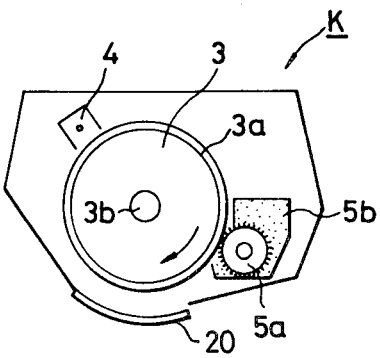
Figure 13F:
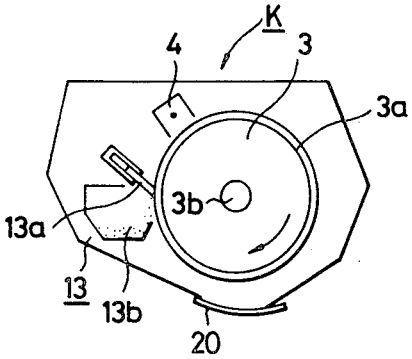

Also, the present embodiment shows an example in which, in addition to the photosensitive drum, various process means such as the developing device, the cleaner, the charger, etc. have been integrally incorporated in the process kit, but the present invention is not restricted thereto. For example, as shown in FIGS. 13A–13F, the array 2, the charger 4, the developing device 5 and the cleaner 13 as the process means, integrally with the photosensitive drum 3, may be incorporated in the kit K (FIG. 13A). Further, the separator means 9*a* may be integrally incorporated (FIG. 13B). Also, the developing device 5 and the photosensitive drum 3 (FIG. 13C), the cleaner 13 and the photosensitive drum 3 (FIG. 13D), the charger 4, the developing device 5 and the photosensitive drum 3 (FIG. 13E), or the charger 4, the cleaner 13 and the photosensitive drum 3 (FIG. 13F) may be integrally incorporated. The image bearing member is not restricted to the photosensitive drum 3, as already mentioned. That is, the process kit K may integrally have the image bearing member and a part or the whole of the process means. The process means acting on the image bearing member are, in the present embodiment, the array 2, the charger 4, the developing device 5, the transfer discharger 8, the separator means 9*a*, and the cleaner 13, etc.

According to the present invention, as has been described above, there can be provided an image formation apparatus in which the image bearing member is protected by a cover and can be prevented from being deteriorated or injured.

What I claim is:

1. An image forming apparatus for forming an image on an image receiving material, comprising:

a main assembly;

means forming a process unit, detachably mountable to said main assembly at a predetermined operating position thereof, for use in forming a said image on said receiving member, said process unit means including an image bearing member, processing means for acting on the image bearing member to form an image, a protection cover for protecting said image bearing member, and supporting means for supporting said cover for movement between a closed position wherein said protection cover covers said image bearing member and an open position wherein said protection cover is retracted from the closed position;

said main assembly including operative means for cooperating with said processing means to complete a said image on the image receiving material; and actuating means for moving said protection cover to the closed position in association with opening a passage for the image receiving material.

2. An image forming apparatus for forming an image on an image receiving material, comprising:

a main assembly;

means forming a process unit, detachably mountable to said main assembly at a predetermined operating position thereof, for use in forming a said image on said receiving material, said process unit means including an image bearing member, processing means for acting on the image bearing member to form an image, a protection cover for protecting said image bearing member, and supporting means for supporting said cover for movement between a closed position wherein said protection cover covers said image bearing member and an open position wherein said protection cover is retracted from the closed position, and means for normally urging said protection cover toward the closed position;

said main assembly including operative means for cooperating with said processing means to complete a said image on the image receiving material;

means for releasably constraining the urging force of said urging means to maintain the protection cover at the open position; and means for releasing the constraint by said constraining means to allow said protection cover to move to the closed position in association with opening of a passage, for the image receiving material.

3. An image forming apparatus for forming an image on an image receiving material, comprising:

an image bearing member;

processing means for acting on the image bearing material to form an image in accordance with image information;

transfer means for transferring the image formed on said image bearing material onto an image receiving member;

a protection cover for protecting said image bearing member;

supporting means for supporting said cover for movement between a closed position wherein said protection cover covers said image bearing member and an open position wherein said protection cover is retracted from the closed position;

means for normally urging said protection cover toward the closed position;

means for releasably constraining the uring force of said urging means to maintain the protection cover at the open position; and means for releasing the constraint by said constraining means to allow said protection cover to move to the closed position in association with opening a passage for the image receiving material.

4. An image forming apparatus according to any one of claims 1, 2, or 3, wherein said passage is opened by dividing said main assembly into two parts.

5. An image forming apparatus according to any one of claims 1, 2, or 3, wherein said passage is opened by lowering a passage guide for the passage from a predetermined position therefor.

6. A process unit according to claim 5, wherein said passage guide includes transportation rollers and a guide for a transfer discharger for transferring the image to the image receiving material.

7. An image forming apparatus according to claims 2 or 3, wherein said urging means includes a spring.

8. An image forming apparatus according to any one of claims 1, 2, or 3, wherein said passage is divisible into an upper assembly and a lower assembly.

9. An image forming apparatus according to claims 1 or 2, wherein said passage is divisible into an upper assembly and a lower assembly, and wherein said process unit means is placed in said upper assembly.

10. An image forming apparatus according to claim 3, wherein said passage is divisible into an upper and lower assemblies, and wherein said image bearing member is provided in said upper assembly.

11. An image forming apparatus according to claim 3, wherein said passage is divisible into an upper and lower assemblies, and wherein said image transfer means is provided in said lower assembly.

12. An image forming apparatus according to claim 2, wherein said passage is divisible into an upper and lower assemblies, and wherein said constraining means includes a projected member provided in said lower assembly.

13. A process unit detachably mountable to a main assembly of an image forming apparatus at a predetermined position thereof to enable image formation on an image receiving material, comprising:

an image bearing member;

processing means for acting on the image bearing member to form an image thereon in accordance with image information;

a protection cover for protecting the image bearing member;

supporting means for supporting said protection cover for movement between a closed position wherein said protection cover covers said image bearing member and an open position wherein said protection cover is retracted from the closed position; and actuating means for moving said protection cover to the closed position in association with opening a passage for the image receiving material.

14. A process kit according to claim 13, wherein said passage is opened by dividing said main assembly into two parts.

15. A process kit according to claim 13, wherein said passage is opened by lowering a passage guide for the passage from a predetermined position therefor.

16. A process kit according to claim 15, wherein said passage guide includes transportation rollers and a guide for a transfer discharger for transferring the image to the image receiving material.

17. A process unit detachably mountable to a main assembly of an image forming apparatus at a predetermined position thereof to enable image formation on an image receiving material, comprising:

an image bearing member;

processing means for acting on the image bearing member to form an image on the image receiving material in accordance with image information;

a protection cover for protecting the image bearing member;

supporting means for supporting said protection cover for movement between a closed position wherein said protection cover covers said image bearing member and an open position wherein said protection cover is retracted from the closed position;

means for normally urging said protection cover toward the closed position; and actuating means for maintaining said protection cover at the open position, against the urging force by said urging means, during image forming operation.

18. A process unit according to claim 17, wherein said urging means includes a spring.

19. The image formation apparatus or the process unit according to claims 1, 2, 3, 13 or 17, wherein said protection cover is for preventing the surface of said image bearing member from being injured.

20. The image formation apparatus or the process unit according to claims 1, 2, 3, 13 or 17, wherein said protection cover is a light-intercepting cover for intercepting light to the surface of said image bearing member.

* * * * *